US006764528B2

(12) United States Patent
Nabeshima et al.

(10) Patent No.: US 6,764,528 B2
(45) Date of Patent: Jul. 20, 2004

(54) PROCESS FOR PRODUCING HIGH-NITROGEN ULTRALOW-CARBON STEEL

(75) Inventors: Seiji Nabeshima, Chiba (JP); Shuji Takeuchi, Chiba (JP); Hisashi Ogawa, Chiba (JP); Yuki Nabeshima, Chiba (JP); Yasuyuki Masumoto, Ichihara (JP)

(73) Assignee: JFE Steel Corporation (JP)

( * ) Notice: Subject to any disclaimer, the term of this patent is extended or adjusted under 35 U.S.C. 154(b) by 46 days.

(21) Appl. No.: 10/203,268

(22) PCT Filed: Dec. 12, 2001

(86) PCT No.: PCT/JP01/10876

§ 371 (c)(1),
(2), (4) Date: Aug. 8, 2002

(87) PCT Pub. No.: WO02/48409

PCT Pub. Date: Jun. 20, 2002

(65) Prior Publication Data

US 2003/0061908 A1 Apr. 3, 2003

(30) Foreign Application Priority Data

Dec. 13, 2000 (JP) ..... 2000-379355
Jan. 5, 2001 (JP) ..... 2001-000424

(51) Int. Cl.[7] ..... C21C 7/10

(52) U.S. Cl. ..... 75/508; 75/512; 148/541; 148/625; 164/55.1; 164/56.1; 164/57.1

(58) Field of Search ..... 75/508, 512; 148/541, 148/625; 164/55.1, 56.1, 57.1

(56) References Cited

U.S. PATENT DOCUMENTS 5,417,739 A * 5/1995 Watkins et al. ..... 75/508
5,693,120 A * 12/1997 Obana et al. ..... 75/384
5,879,479 A * 3/1999 Nabeshima et al. ..... 148/541

* cited by examiner

*Primary Examiner*—Melvyn Andrews
(74) *Attorney, Agent, or Firm*—Piper Rudnick LLP

(57) ABSTRACT

A method of producing a high nitrogen, ultra low carbon steel suitable to rolling material for use in cold rolled steel sheets having excellent age hardening property by an age hardening treatment after forming by working, with no defects in slabs or steel sheets, reliably, at a reduced cost and with a high productivity is proposed.

The method for producing a rolling material for use in ultra low carbon steel sheets at: C≦0.0050 mass % comprises;

applying primary decarburization refining to molten iron from a blast furnace, then controlling the composition in the molten steel after primary decarburization refining to a range satisfying the following relation:

$$[\text{mass \% N}]-0.15[\text{mass \% C}]\geqq 0.0060,$$

subsequently conducting secondary decarburization refining to a ultra low carbon concentration region while suppressing denitridation using a vacuum degassing facility, then conducting deoxidation by Al and, further, controlling the composition.

19 Claims, 6 Drawing Sheets

PROCESS FOR PRODUCING HIGH-NITROGEN ULTRALOW-CARBON STEEL

TECHNICAL FIELD

This invention concerns a method of producing a ultra low carbon steel at high nitrogen concentration, particularly, a ultra low carbon steel at high concentration of solid-solute N. The ultra low carbon steel at high nitrogen concentration can be applied, for example, with rolling to obtain a ultra low carbon steel sheets (thin steel sheets) of high age hardening property. The high nitrogen ultra low carbon steel sheets can be used for portions such as of automobile structural parts, which require structural strength, particularly, strength and/or rigidity upon deformation.

BACKGROUND ART

As one of steel sheets suitable, for example, to automobile structural parts, steel sheets which have favorable workability and can be improved for the strength by an aging heat treatment after once being formed (hereinafter referred to as age hardening property) have been proposed. In the steel sheets, the strength can be improved by applying forming such as press forming in a relatively soft state before the age hardening treatment into a desired shape and then applying an aging heat treatment such as baking. As the steel for use in sheets of this type, a ultra low carbon steel at C≦0.0050 mass % is considered suitable with a view point of the workability, and it has been proposed a composition in which solid solute N can be present, for example, by 0.0030 mass % or more, preferably, 0.0050 mass % or more in steel sheets with a view point of aging property.

However, for refining to form a steel of such excellent workability, Al is generally added in view of deoxidation (such a steel is referred to as aluminum killed steel). Further, for refining of crystal grain size in the ultra low carbon steel, a technique, for example, of adding Nb or B into the steel has often been adopted. Since the elements described above form nitrides, it is necessary for insuring solid solute N in the steel sheets, to control the nitrogen concentration for compensation of the nitrogen content that is converted into nitrides upon steel making. For example, in a case where Al concentration in the steel is 0.015 mass % or more, it is necessary for high N concentration of about 0.0120 mass % or more in order to ensure a sufficient content of solid solute N.

As a method of producing a steel of high N concentration, Japanese Patent Laid-Open No. 91317/1986 discloses a method of blowing a nitrogen gas from a submerged lance into a molten steel in a ladle refining furnace under an oxygen free atmosphere. However, since this method is a treatment in the ladle refining furnace, it is difficult to apply, for example, a vacuum degassing treatment, so that it is extremely difficulty to obtain a ultra low carbon steel.

On the other hand, for the method of producing a high N steel of conducting the vacuum degassing treatment, Japanese Patent Publication No. 34848/1980. Japanese Patent Laid-Open No. 25919/1981 and Japanese Patent Laid-Open No. 28319/1989 disclose methods of controlling the pressure in a vacuum vessel to a pressure equilibrated with an aimed N concentration after the vacuum degassing step, utilizing a nitrogen gas as a part or entire of a gas to be blown into a molten steel, and keeping for a predetermined period of time, thereby adding nitrogen sufficiently.

However, the nitrogen injection method by a nitrogen gas involves a drawback that the nitrogen increasing rate is slow.

Particularly, in the steel material used for steel sheets to be worked, since Cr concentration is low different from stainless steel and the like, the nitrogen solubility is low and it is difficult to attain a processing speed suitable to industrial production. While the disclosed technique propose an attempt of increasing nitrogen up to an equilibrated nitrogen concentration by increasing the pressure in the vacuum vessel, this also requires a long time to reach the equilibrated nitrogen concentration when the initial nitrogen concentration is low.

For example, in a case of a pressure at $1\times10^4$ Pa in a vacuum vessel where the equilibrated nitrogen concentration is 0.0150 mass %, increase is only up to about 0.0100 mass % by a treatment for 15 min when the initial nitrogen concentration is about 0.0080 mass %. Accordingly, when the aimed nitrogen concentration is, for example, 0.0120 mass % or more as described above, it is extremely difficult to attain the aimed value by the injection of the nitrogen gas. Although the nitrogen concentration may be increased by increasing the pressure in the vacuum vessel, the pressure in the vacuum vessel as exceeding $2.0\times10^4$ Pa lowers a stirring force for the molten steel in a vacuum vessel or a ladle to hinder the homogeneity in the molten steel.

A method of blowing a nitrogen gas or a nitrogen-Ar gas mixture in a vacuum degassing apparatus under a reduced pressure to control the pressure in the vacuum vessel thereby controlling the nitrogen concentration in the molten steel has been disclosed in Japanese Patent Laid-Open No. 17321/2000, Japanese Patent Laid-Open No. 17322/2000, Japanese Patent Laid-Open No. 34513/2000 and Japanese Patent Laid-Open No. 100211/1996. However, like the techniques described previously, nitrogen increasing rate in the injection of nitrogen by the nitrogen gas is slow and it takes a long processing time in ordinary steels, which is not practical.

Further, Japanese Patent No. 2896302 discloses a technique of changing the pressure in a vacuum vessel and decreasing nitrogen to less than an aimed nitrogen concentration of a molten steel and then adding a nitrogen-containing alloy to conduct fine control as far as the aimed nitrogen concentration. To ensure the aimed nitrogen concentration by the addition of the nitrogen-containing alloy brings about the change of the steel composition by the alloy. For example, it results in a problem that the C concentration in the molten steel is increased by C contained in the alloy. At the same time, the nitrogen-containing alloy with controlled composition is expensive and it is difficult aside from special steels, to adopt such an uneconomical method for steel species as in steel sheets put to ordinary working that require mass production and production at reduced cost.

Further, Japanese Patent Laid-Open No. 216439/1995 discloses a method of blowing a nitrogen gas into a molten steel in primary decarburization refining and secondary vacuum decarburization refining thereby refining to form a steel at a high nitrogen content of 0.0100 mass % or more in a ultra low carbon steel at 0.0050 mass % or less. However, when the denitridation reaction along with the decarburizing treatment in the secondary refining is taken into consideration, this method requires addition of a great amount of nitrogen in total compared with a case of adding nitrogen only in the secondary refining. Accordingly, in conjunction with the low processing rate for the high nitrogen treatment, only low production efficiency can be expected by the gas in this method.

Further, it has been actually difficult to attain an N content of 0.0120 mass % or more in a ultra low carbon steel at: C≦0.005 mass % by any of the methods described above.

DISCLOSURE OF THE INVENTION

OBJECT OF THE INVENTION

This invention proposes a method of producing, at a reduced cost and with high productivity, a steel for obtaining a steel sheet to be worked which contains nitrogen at high concentration (solid-solute nitrogen) and ultra low carbon content. The steel obtained by the method according to this invention is served particularly for application use in which an aging heat treatment is applied for improving the strength after forming such as press forming and which is suitable as a rolling material for steel sheets having excellent age hardening property.

SUMMARY OF THE INVENTION

The present inventors have made earnest studies for attaining the foregoing object and, as a result, have found a new subject, in producing a high nitrogen steel in a ultra low carbon aluminum killed steel, that AlN is precipitated to cause AlN-induced surface crackings in cast slabs or sheet bars during continuous casting and hot rolling unless the amount of Al added to the steel upon deoxidation is controlled appropriately. Then, it has been succeeded in solving the problems described above, by providing an upper limit for the concentration of Al and N to prevent lowering of the product yield and ensure the productivity.

Further, the present inventors have succeeded in obtaining a desired high nitrogen content efficiently while ensuring the reduced cost and productivity, particularly, the production speed, by the procedures of optimizing the concentration of nitrogen and carbon after primary refining, controlling denitridation along with decarburization in secondary refining in a vacuum degassing facility and, optionally adding nitrogen. It is preferred in view of the cost and the productivity, to control the amount of nitrogen in the primary refining by the blowing of a nitrogen-containing gas or addition of a nitrogen-containing alloy, to control denitridation in the secondary refining by blowing of a suitable nitrogen-containing gas or control the amount of oxygen in the steel and to adjust nitrogen upon subsequent Al killed treatment by the nitrogen-containing gas and an composition-controlled nitrogen containing alloy.

That is, this invention provides a method of producing a rolling material for use in ultra low carbon steel sheets of high age hardening property in producing a rolling material for use in ultra low carbon steel sheets at: $C \leqq 0.0050$ mass %, characterized by applying primary decarburization refining to molten iron from a blast furnace, controlling the composition in the molten steel after the primary decarburization refining to a range satisfying the following relation (1), then conducting secondary decarburization refining to a ultra low carbon concentration region at: $C \leqq 0.0050$ mass % so as to satisfy the following relation (2) in a vacuum degassing facility, subsequently conducting deoxidation by Al so as provide: $Al \geqq 0.005$ mass % after deoxidation, further, controlling the composition such that N: 0.0050–0.0250 mass % and the N concentration satisfies the following relation (3) and, successively, casting the thus composition-controlled molten steel at continuous casting process.

Note:

$$[\text{mass \% N}]-0.15[\text{mass \% C}] \geqq 0.0060 \quad (1)$$

$$\Delta N/\Delta C \leqq 0.15 \quad (2)$$

in which $\Delta N$: reduction amount of the N concentration in steel in the secondary decarburization refining (mass %)

$\Delta C$: reduction amount of the C concentration in steel in the secondary decarburization refining (mass %)

$$[\text{mass \% Al}]\cdot[\text{mass \% N}] \leqq 0.0004 \quad (3)$$

For improving the age hardening property of steel sheets obtained from the steel according to this invention, it is preferred that the N concentration further satisfies, in the composition control, the following relation (4):

$$[\text{mass \% N}] \geqq 0.0030+14/27[\text{mass \% Al}]+14/93[\text{mass \% Nb}]+14/11[\text{mass \% B}]+14/48[\text{mass \% Ti}] \quad (4),$$

thereby ensuring an appropriate amount of solid solute N. The steel according to this invention does not necessarily contain Nb, B and Ti and the value for the concentration of the not contained element in the formula described above is calculated as zero.

This invention is not restricted to the steels satisfying the relation (4) but is suitable to the production, particularly, of high nitrogen steels at N: 0.0120 mass % or more.

During the secondary decarburization refining, it is preferred to blow a gas that contains a nitrogen gas, for example, a nitrogen gas or a gas mixture of nitrogen and argon at a nitrogen gas flow rate: 2 Nl/min·t or more into the molten steel to provide: $\Delta N/\Delta C \leqq 0.15$. Further, it is preferred to control the N concentration also in deoxidation by Al in a vacuum degassing facility after the secondary decarburization refining by blowing a gas that contains a nitrogen gas at a nitrogen gas flow rate: 2 Nl/min·t or more. There is no particular restriction on the method of blowing the gas into the molten steel, and may be a method of blowing from a ladle not only from a snorkel or may be a method of blowing the gas to the surface of the molten steel.

Further, the gas that contains the nitrogen gas further contains preferably a reducing gas, for example, a hydrogen gas with a view point of the efficiency for nitrogen supply. The reducing gas is preferably 5 to 50 vol % (normal temperature normal pressure) of the gas that contains the nitrogen gas.

The nitrogen containing gas that contains the reducing gas can be used also for increasing the nitrogen concentration during primary refining.

Further, it is also preferred to control the concentration of oxygen in the molten steel to 0.0300 mass % or more during secondary decarburization refining to provide: $\Delta N/\Delta C \leqq 0.15$.

Further, the composition of the molten steel before the secondary decarburization refining preferably satisfies the following relation (5):

$$[\text{mass \% N}]-0.15[\text{mass \% C}] \geqq 0.0100 \quad (5)$$

As a specific numerical value, the composition in the molten steel before the secondary decarburization refining is preferably $N \geqq 0.0080$ mass %. More preferably, it is controlled to as: $N \geqq 0.0100$ mass %.

In the control for the ingredients in the molten steel before the secondary decarburization refining, it is preferred to control the N concentration by adding an N-containing alloy to the molten steel after the primary decarburization refining and before the secondary decarburization refining.

Further, it is preferred to suppress lowering of the N concentration by adjusting the pressure in the vacuum vessel to $2\times10^3$ Pa or more during deoxidation by Al (killed treatment) in the vacuum degassing facility after the secondary decarburization refining.

Further, it is preferred to control the N concentration by adding an N-containing alloy at: [mass % C]/[mass % N]≦0.1 into the molten steel during deoxidation by Al in the vacuum degassing facility after the secondary decarburization refining. This is preferably conducted with an aim of fine control for the N concentration.

The composition of the molten steel controlled with the composition preferably contains Si: 1.0 mass % or less, Mn: 2.0 mass % or less and total oxygen: 0.0070 mass % or less and contains one or more of Nb: 0.0050 to 0.0500 mass %, B: 0.0005 to 0.0050 mass % and Ti: 0.070 mass % or less (including zero), with the substantial balance being Fe.

BRIEF EXPLANATION FOR THE DRAWINGS

BEST MODE FOR CARRYING OUT THE INVENTION

Figure 1:
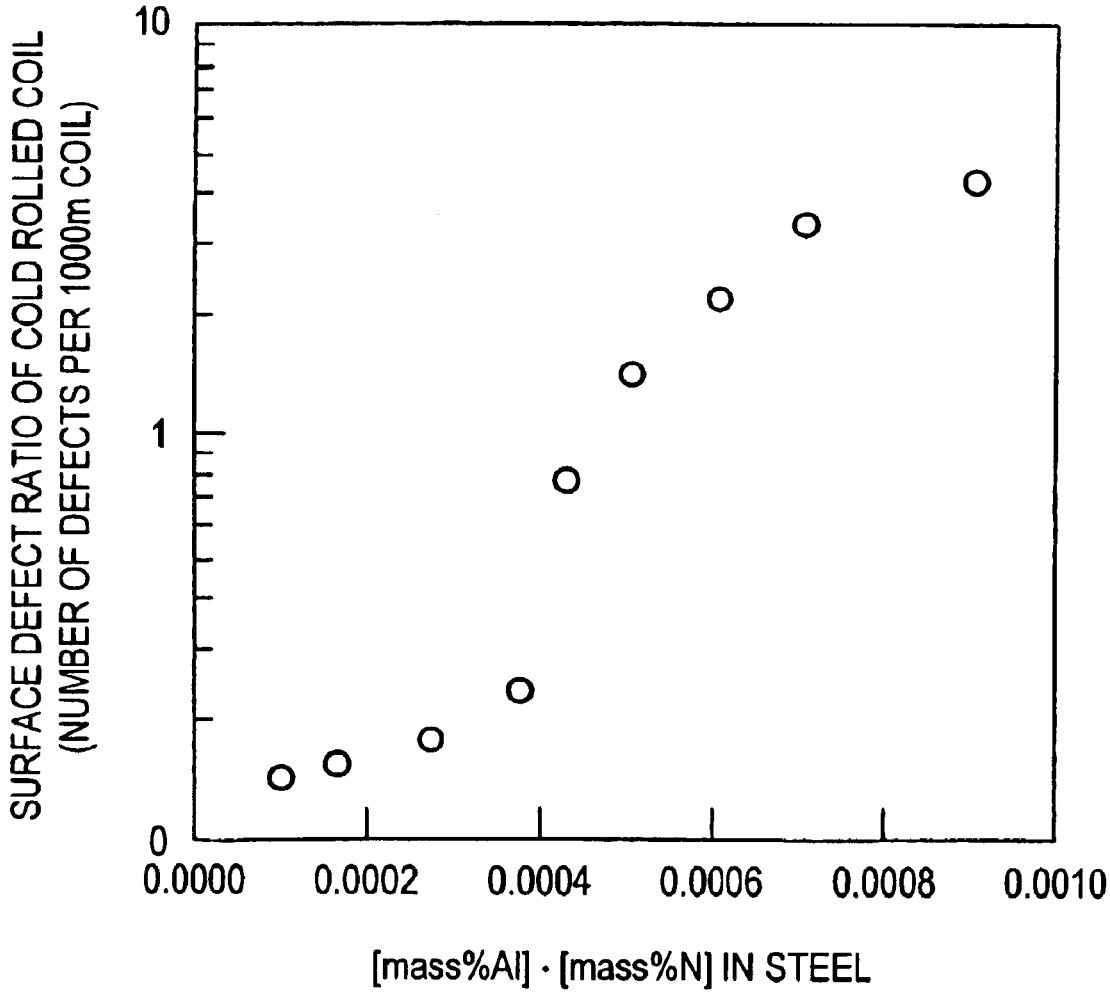
FIG. 1 is a chart showing a relation between [mass % Al]·[mass % N] in the steel and the surface defect ratio in cold rolled coils (number of defects per 1000 m coil).

Now, in the method of this invention, reasons for defining each of the conditions are to be explained specifically.

At first, description is to be made to an N concentration to be attained in this invention for the composition. For ensuring the concentration of solid-solute nitrogen capable of obtaining high strength, particularly, aging hardening property, the nitrogen concentration is required to be 0.0050 mass % or more. For obtaining more reliable and higher age hardening property, the nitrogen concentration is preferably 0.0080 mass % or more and, more preferably, 0.0100 mass %. It is more preferably 0.0120 mass % or more and, further preferably, 0.0150 mass % or more.

On the other hand, when the nitrogen concentration exceeds 0.0250 mass %, bubble-induced pinholes are often formed in continuously cast slabs to cause streak-like defects frequently in cold rolled sheets, so that the nitrogen concentration in the molten steel in the casting stage after the completion of refining is preferably 0.0250 mass % or less.

The result of the experiment leading to the relation (4) as the amount of N that develops excellent age hardening property is to be explained. After uniformly heating, at 1150° C., a steel ingot of a composition comprising composition in a range as: C: 0.0020 to 0.0025 mass %, Si: 0.01 mass %, Mn: 0.48 to 0.52 mass %, P: 0.025 to 0.030 mass %, S: 0.006 to 0.010 mass %, Al: 0.005 to 0.030 mass %, B: 0.0001 to 0.0040 mass %, Nb: 0.001 to 0.030 mass %, N: 0.0060 to 0.0150 mass %, and the balance of Fe and inevitable impurities, it was hot rolled to a sheet thickness of 4 mm with a finishing temperature at 900° C. which is above the Ar3 transformation point, and water cooled after completion of the rolling. Then, the hot rolled sheets were annealed at 500° C. for 1 hour and cold rolled at a reduction of 80%, put to recrystallization annealing at 800° C. for 40 min and, further, temper rolled at a reduction of 0.8%.

The obtained steel sheet was used as a test material (temper rolled material) and put to a tensile test at a strain rate of 0.02/s. Separately, a tensile test was conducted also for a test material (aging-treated material) obtained by applying 10% tensile strains and the aging heat treatment at 120° C. for 20 min to the steel sheet. The age hardening amount was determined based on the difference: ΔTS=TS2−TS1 between the tensile strength of the age-hardening-treated material (TS2) and tensile strength of the temper rolled material (TS1).

Figure 2:
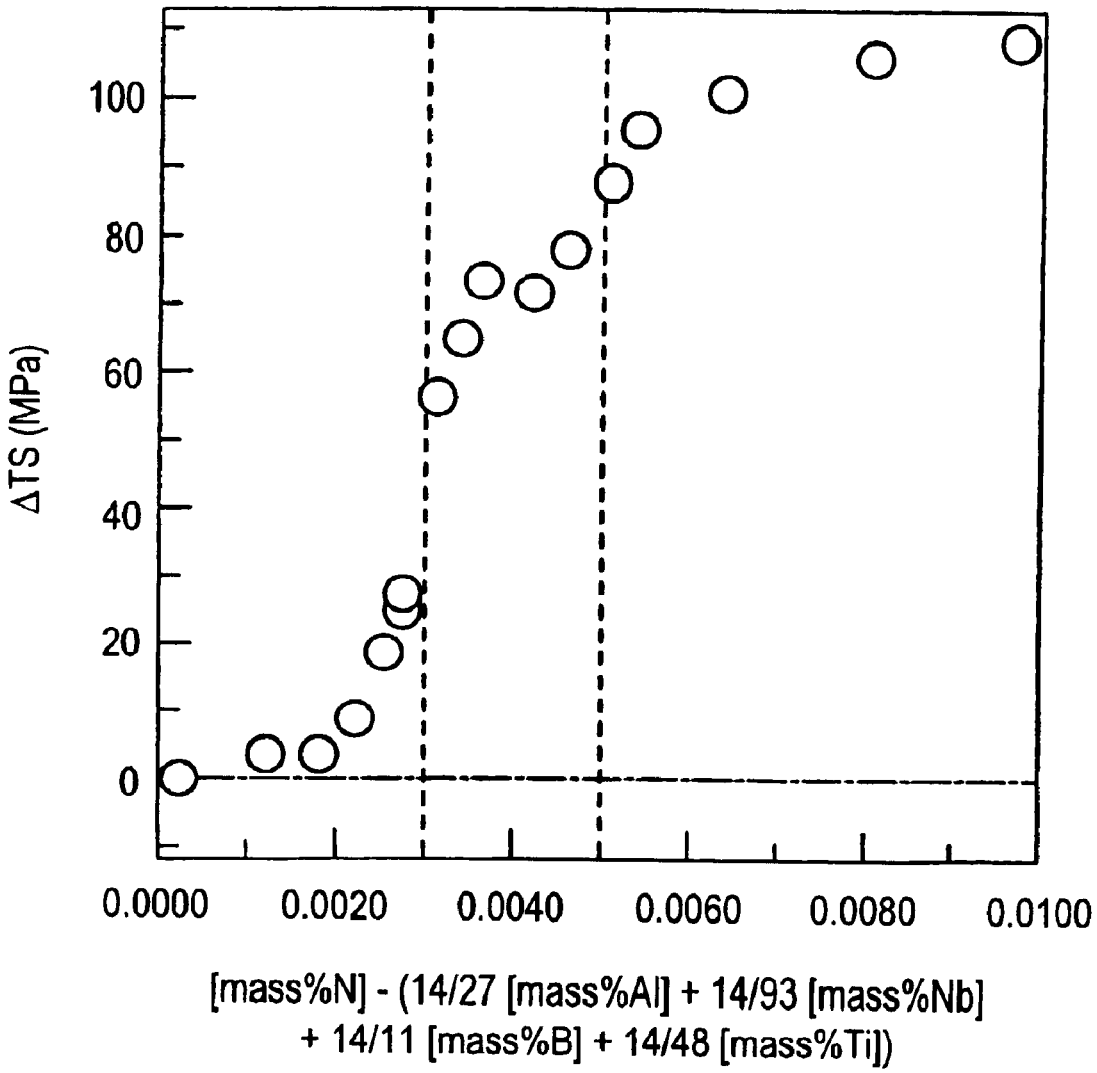
FIG. 2 is a chart showing a relation between [mass % N]−(14/27[mass % Al]+14/93[mass % Nb]+14/11[mass % B]+14/48[mass % Ti]) and ΔTS.

FIG. 2 shows a relation between [mass % N]−(14/27[mass % Al]+14/93[mass % Nb]+14/11[mass % B]+14/48[mass % Ti]) in the steel composition after refining and ΔTS. It has been found from FIG. 2 that ΔTS is 60 MPa or more when [mass % N]−(14/27[mass % Al]+14/93[mass % Nb]+14/11[mass % B]+14/48[mass % Ti]) satisfies 0.0030 mass % or more. More preferably, 80 MPa or more can be obtained as ΔTS when the value of the formula satisfies 0.0050 mass % or more. Such values are sufficient for excellent age hardening property.

From the foregoing result, it can be considered that [mass % N]−(14/27[mass % Al]+14/93[mass % Nb]+14/11[mass % B]+14/48[mass % Ti]) is suitable as a formula for approximately estimating the amount of solid solute N in the steel sheets obtained according to the steel of this invention. Accordingly, it is preferred for the development of the excellent age hardening property to satisfy the following relation (4):

$$[\text{mass \% N}] \geqq 0.0030 + 14/27[\text{mass \% Al}] + 14/93[\text{mass \% Nb}] + 14/11[\text{mass \% B}] + 14/48[\text{mass \% Ti}] \quad (4),$$

in which

[mass % Nb]=0 in the steel not containing Nb

[mass % B]=0 in the steel not containing B

[mass % Ti]=0 in the steel not containing Ti

Then, with regard to the Al concentration, when Al concentration upon completion of RH treatment (that is, after refining) is less than 0.005 mass %, the oxygen concentration in the steel increases abruptly in which a great amount of defects due to macro inclusions are formed upon cold rolling or the like of the steel to cause surface defects in the cold rolled steel sheets as the product, or a great amount of cracks are formed during press forming of the steel sheets. Accordingly, the Al concentration upon completion of RH treatment has to be 0.005 mass % or more. While it is preferably 0.010 mass % or more, since the solid solute nitrogen decreases as the Al concentration is increased, it is preferred to increase the N concentration correspondingly.

Further, it is necessary to increase also the N concentration when the Al concentration is increased. However, when [mass % Al]·[mass % N]>0.0004 after refining, a number of cracks are formed on the surface of the cast slabs and/or sheet bars during continuous casting and/or hot rolling and, further, streak-like defects are often formed also in the cold rolled sheets. FIG. 1 shows a relation investigated between [mass % Al]·[mass % N] in the steel and the surface defect ratio in the cold rolled coils (number of defects per 1000 m coil) after the continuous casting, hot rolling and cold rolling. As a result of the investigation, it has been found that the surface defect ratio increases drastically in the cold rolled coils when [mass % Al]·[mass % N]>0.0004.

Accordingly, it is necessary that the value for [mass % Al]·[mass % N] is 0.0004 or less. The N concentration and the Al concentration described above were arranged as shown in FIG. 3.

Figure 3:
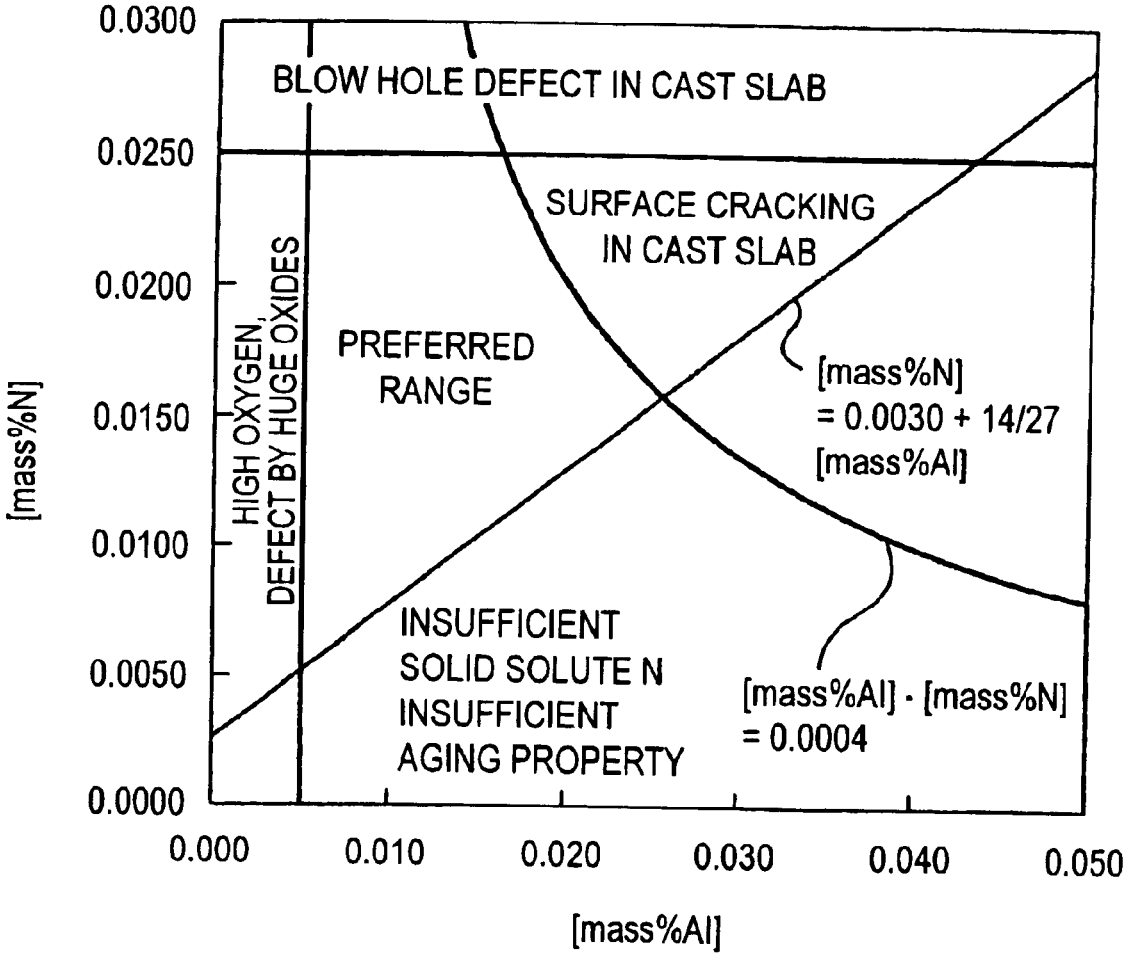
FIG. 3 is a chart showing ranges for aimed composition after refining upon obtaining steels having high age hardening property.

For ensuring solid solute N, the substantial upper limit for Al is about 0.025% in view of FIG. 3. Further, for ensuring N: 0.0120 mass % or more after refining, the substantial upper limit of Al is about 0.033% in view of the restriction of [mass % Al]·[mass % N].

Then, the method of refining for obtaining above composition is to be explained below.

Generally, for refining a ultra low carbon steel (C≦0.0050 mass %), it is basic procedures of conducting primary decarburization refining in a converter furnace or the like, and then conducting secondary decarburization refining by putting a molten steel under a reduced pressure of $5\times10^2$ Pa (about 3.8 Torr; about 0.005 atm) or lower by using a vacuum degassing facility so that CO is formed by the reaction of C and O in the molten steel.

Since denitridation proceeds along with decarburization, it may be considered to moderate the decarburizing step. However, excessive decrease of carbon after the primary refining for this purpose is not preferred since this promotes the formation of iron oxides to lower the steel yield and form a great amount of inclusions, of which iron oxides is the oxygen source, in the Al-deoxidized steel to increase surface defects in the slabs or steel sheets. In view of the above, the present inventors have made various studies on the means for suppressing denitridation in the secondary decarburization refining and have newly found that denitridation proceeds in proportion with the amount of decarburization in a case where the nitrogen concentration in the molten steel is high. Then, it has further been found that the proportional coefficient can be decreased to some extent by the control of various conditions in the refining. Based on the findings, the present inventors further made studies regarding the burden or a like of the nitrogen addition or reduction of nitridation on each of the steps and have found that it is extremely suitable, for reducing the amount of denitridation within a range that gives less burden on the productivity or the cost, to decrease the ratio $\Delta N/\Delta C$ between the reduction amount $\Delta N$ of the nitrogen concentration and the reduction amount $\Delta C$ of the carbon concentration during the secondary decarburization refining to 0.15 or less. Since $\Delta N/\Delta C$ sometimes becomes negative (nitridation) depending on the condition, for example, by optimization for the blowing of the nitrogen-containing gas to be described later, the lower limit for $\Delta N/\Delta C$ is not defined particularly.

Further, it is necessary to control the composition in the molten steel after the primary decarburization refining and before the secondary decarburization refining by the vacuum degassing treatment to low C concentration and high N concentration such that the carbon concentration and the nitrogen concentration in the molten steel before and during the second decarburization refining by the vacuum degassing treatment can satisfy the following relation (1):

$$[\text{mass \% N}]-0.15[\text{mass \% C}]\geqq 0.0060 \quad (1)$$

Figure 4:
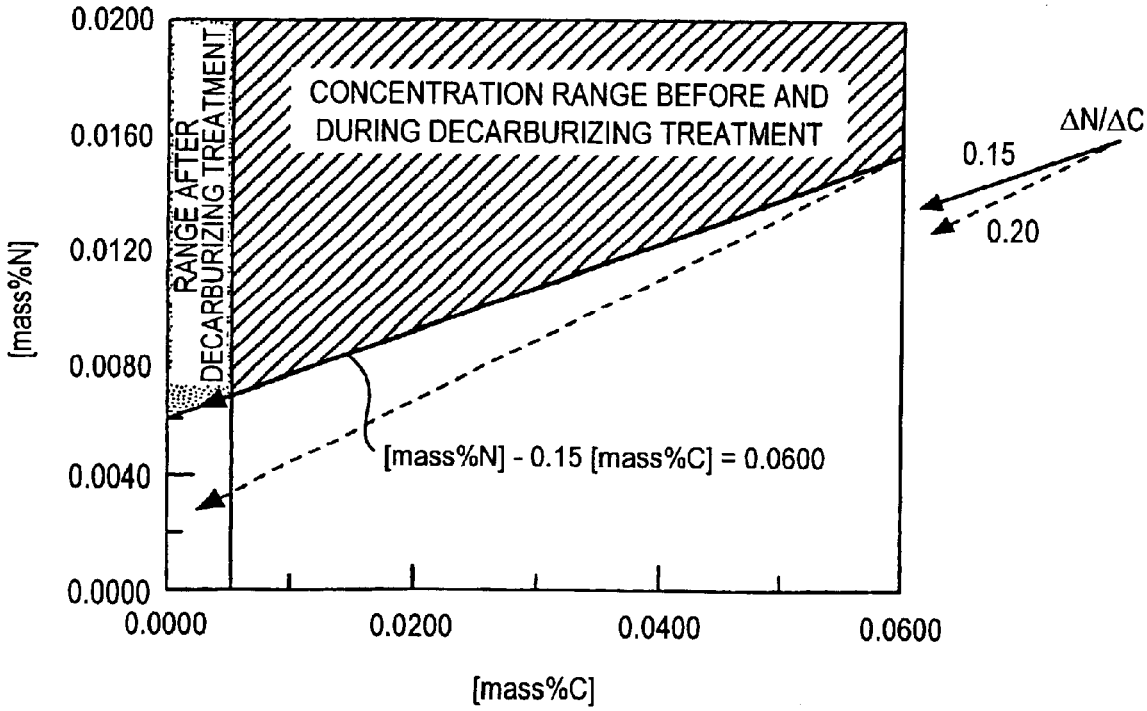
FIG. 4 is a chart showing concentration ranges for carbon and nitrogen before, during and after decarburizing treatment.

This is because [mass % N] after the secondary decarburization refining is lower than 0.0060 mass % in a case where $\Delta N/\Delta C=0.15$ unless the [mass % N], [mass % C] can satisfy the relation (1). Further, [mass % N] after the steel decarburization refining is also lower than 0.0060 mass % if $\Delta N/\Delta C>0.15$ although the relation (1) is satisfied. FIG. 4 shows a relation between the carbon concentration and the nitrogen concentration before, during and after the decarburizing treatment by arranging the relations described above.

The nitrogen concentration after the secondary decarburization refining can be increased to 0.0060 mass % or more by conducting the secondary decarburization refining in accordance with the conditions described above. When the N concentration after the secondary decarburization refining is 0.0060 mass % or more, it is easy to increase the N concentration after the vacuum degassing treatment to 0.0050 mass % or more, for example, by blowing an $N_2$-containing gas in the subsequent Al-deoxidation treatment.

Amore preferred condition for the ingredients in the molten steel after the primary decarburization refining and before the secondary decarburization refining by the vacuum degassing treatment preferably satisfies the following relation (5):

$$[\text{mass \% N}]-0.15[\text{mass \% C}]\geqq 0.0100 \quad (5)$$

Figure 5:
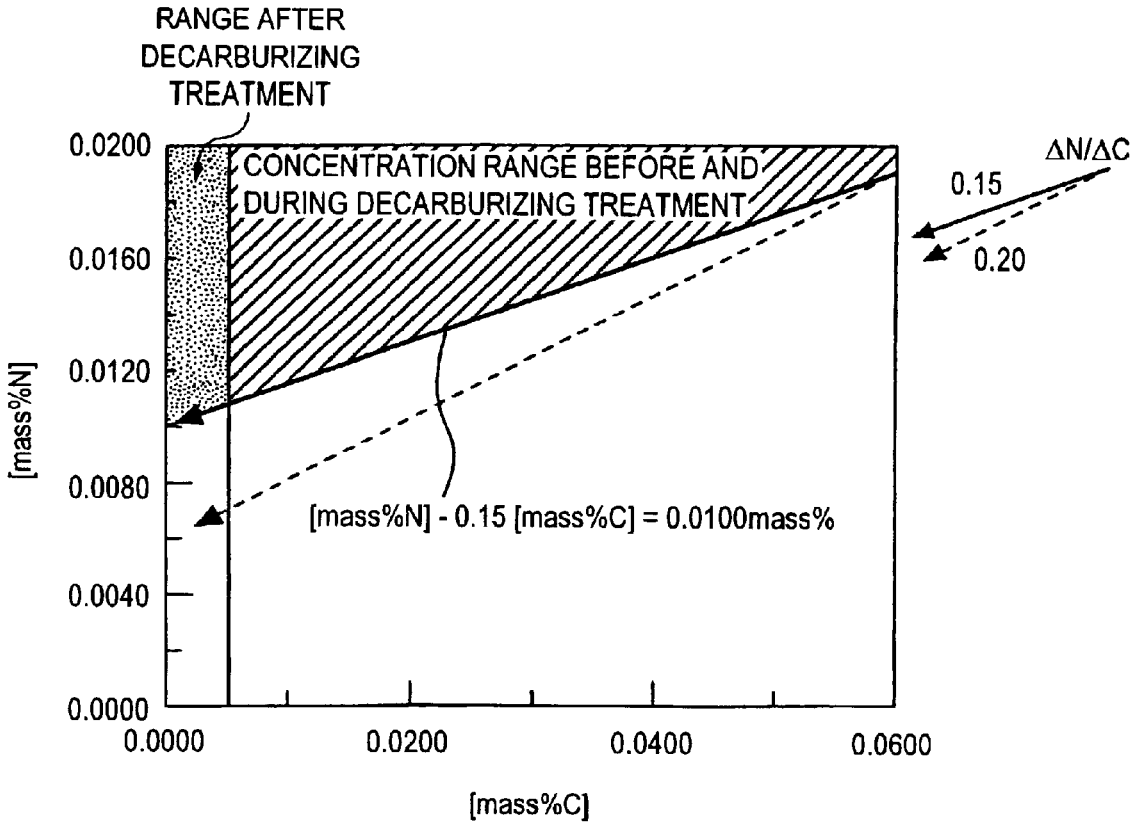
FIG. 5 is a chart showing a more preferred concentration ranges for carbon and nitrogen before, during and after the decarburizing treatment.

When the relation is satisfied, it is easy to ensure [mass % N] after the secondary decarburization refining to 0.0100 mass % or more. FIG. 5 shows a relation between the carbon concentration and the nitrogen concentrations before, during and after the decarburizing treatment in this case. When the N concentration after the decarburizing treatment is set to 0.0100 mass % or more in accordance with the conditions described above, for example, by blowing an $N_2$-containing gas in the subsequent Al-deoxidation treatment, it is possible to increase the N concentration after the vacuum degassing treatment to 0.0120 mass % or more which was particularly difficult so far. Further, also in a case where the aimed N concentration is less than 0.0120 mass %, it is preferred to satisfy the relation (5) in view of the operation efficiency.

For controlling the N concentration and the C concentration after the primary decarburization refining and before the secondary decarburization refining within the range of the relation (1) or relation (5) above, it is preferred to satisfy the relation by increasing the N concentration. For increasing the N concentration in accordance with the relation (1) or relation (5), a method of adding an N-containing alloy such as N—Mn after the primary decarburization refining (for example, upon tapping from the converter furnace) is effective. Since the change of the composition caused by the addition of the nitrogen-containing alloy in this stage can be adjusted by the secondary refining, a relatively inexpensive alloy can be used. As the nitrogen-containing alloy, although N—Cr or N-containing lime may also be added, a care may be necessary for the increase of the Cr concentration in the case of N—Cr, or for the increase of slugs in a case of N-containing lime. For this reason, N—Mn is preferred as the nitrogen-containing alloy.

In addition, blowing of a nitrogen-containing gas in the molten steel upon primary decarburization refining is also suitable as a method of increasing the N-concentration. While there are no particular restrictions on the type of the gas and the method of blowing, it is general to blown-in a nitrogen gas from a top brown lance and/or bottom blown lance. It is preferably blown at the stage where the C concentration is 0.3 mass % or more.

Further, as a method of attaining: $\Delta N/\Delta C\leqq 0.15$ in the secondary decarburization refining, a method of blowing a nitrogen-containing gas into the molten steel, particularly, blowing of a nitrogen-containing gas as a circulation gas blown from a snorkel into the molten steel in a method of using an RH type vacuum degassing facility as a vacuum degassing facility is particularly effective. A nitrogen gas or a gas mixture of nitrogen and argon is used preferably as the nitrogen-containing gas and it is preferred that the gas is blown in an amount under the condition where the flow rate of the nitrogen gas is 2 Nl/min·t or more. In addition, the nitrogen-containing gas may also be blown from a blowing port of the ladle or RH facility. Further, the gas is blown into a molten state also by a method of blowing, for example, from the blowing lance at the upper surface toward the surface of the molten steel (top blowing).

Further, $\Delta N/\Delta C \leqq 0.15$ can be attained by increasing the oxygen concentration to 0.0300 mass % or more during the secondary decarburization refining by utilizing the effect of the dissolved oxygen in the motel steel of lowering the chemical kinetics constant of the denitridation. The oxygen concentration can be controlled to a desired value by controlling the amount of the oxygen that is blown for the promotion of decarburization or the like.

Further, the efficiency of supplying nitrogen into the steel by the gas can be improved by mixing a reducing gas such as a hydrogen gas with the nitrogen-containing gas to be blown. According to the experiment of the inventors, it has been found that the nitrogen concentration after the primary refining can be reduced by about 30 ppm compared with a case of blowing the nitrogen-containing gas that does not contain the reducing gas in an identical amount providing that the aimed nitrogen concentration is identical (after refining), by incorporating the reducing gas by 5 to 50 vol %, preferably, 10 to 40 vol % (value at normal temperature and normal pressure). Particularly, when the concentration of oxygen in the steel is high, the effect of adding the reducing gas is higher but the effect can be recognized also at a low oxygen concentration.

It is considered that effect of the reducing gas is attributable to the following mechanism. Oxygen in the steel is a surface activating element and it is considered that it suppresses both the denitridation reaction from the steel and the nitrogen absorption reaction from the nitrogen-containing gas into the steel. When the reducing gas is mixed at an appropriate ratio in the nitrogen gas, the oxygen concentration at the interface between the molten steel and the nitrogen added gas phase can be lowered locally without lowering the oxygen concentration in the molten steel to promote the nitrogen absorption reaction. Further, it is considered that also the effect of promoting the molten steel flow near the gas-molten steel interface due to the Marangoni's effect also contributes to the improvement of the nitrogen absorption rate. Since the reducing gas diffuses in the area other than the nitrogen containing gas blowing portion, there is no remarkable reduction for the oxygen concentration in other portions.

When the gas is blown to the surface of the molten steel, the improving effect for the nitrogen absorption ratio by the addition of the reducing gas is particularly great.

As the reducing gas, a hydrocarbon gas such as propane or carbon monoxide may also be used in addition to the hydrogen gas described above. However, since carbon monoxide or hydrocarbon gas contains carbon, it may possibly increase the decarburization cost due to the increase of carbon in the steel and the use of a gas that does not contain carbon such as a hydrogen gas is suitable in view of the cost.

After the completion of the vacuum decarburization refining, for reducing the oxygen concentration in the steel in the vacuum degassing vessel successively, Al-deoxidation treatment is applied to the molten steel, and final composition control (fine control) is usually conducted, for example, by charging ores at the final stage of the deoxidation. In this process, the N concentration after the control for the ingredients has to be controlled to 0.0050 to 0.0250 mass %. For this purpose, a method of blowing a nitrogen-containing gas into the molten steel in the stage of Al-deoxidation, particularly, a method of blowing a nitrogen-containing gas as a circulation gas blown from a snorkel in an RH type vacuum degassing facility is effective. As the nitrogen-containing gas, a nitrogen gas or a gas mixture of nitrogen and argon is used preferably and the gas is preferably blown in an amount under the condition that the flow rate of the nitrogen gas flow rate is 2 Nl/min·t or more. In this case, the reducing gas may be mixed as described above and the gas blowing method is not restricted only to that from the snorkel but may be by way of the methods described previously.

Figure 6:
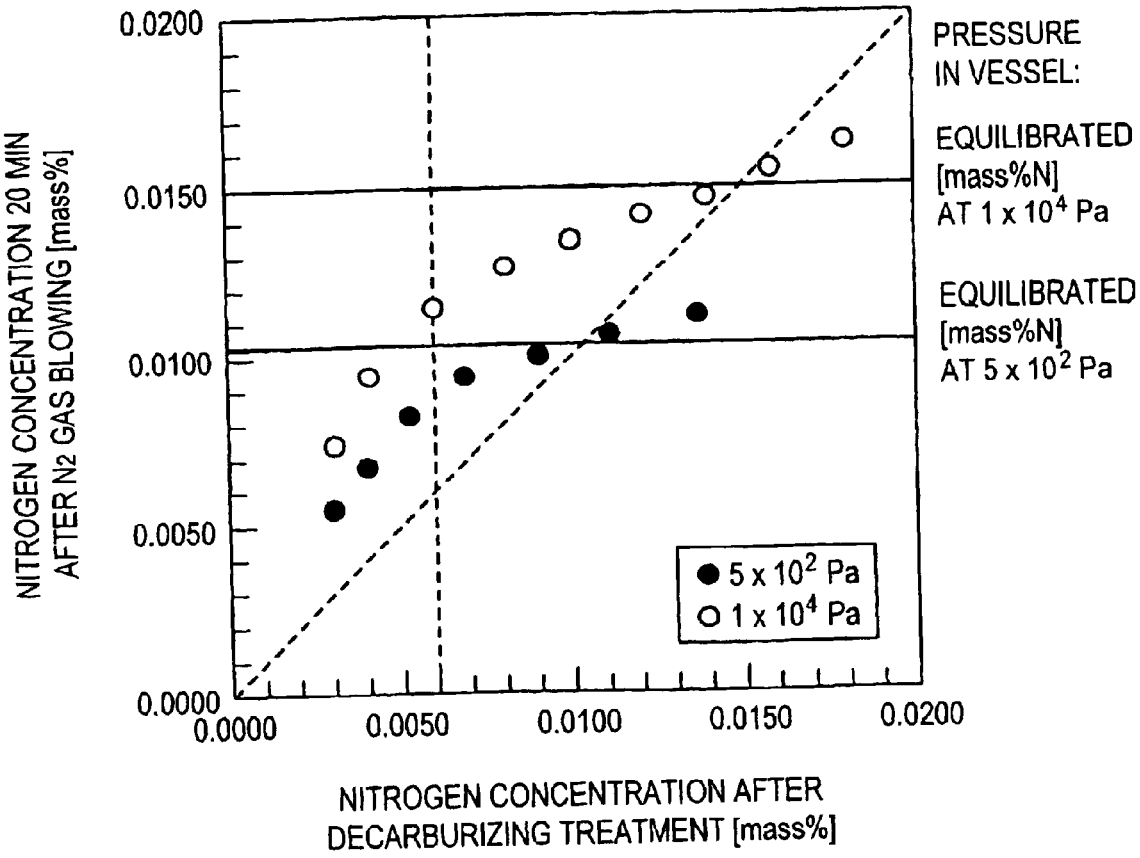
FIG. 6 is a chart showing a relation between the nitrogen concentration after the decarburizing treatment, the pressure recovery and the nitrogen concentration 15 min after $N_2$ blowing.

Further, it is effective in this process to increase the pressure in the vacuum vessel to $2\times10^3$ Pa or more to suppress denitridation from the surface of the molten steel bath under vacuum. FIG. 6 shows a relation between the nitrogen concentration after the decarburizing treatment and the nitrogen concentration 20 min after the $N_2$ gas blowing under low vacuum degree (nitrogen gas flow rate: 10 Nl/min·t). In a case where the nitrogen concentration after the decarburization refining is set to 0.0060 mass % or more in accordance with the relation (1) and relation (2), the nitrogen concentration can be increased by the blowing of the nitrogen-containing gas under low vacuum ($1\times10^4$ Pa, $5\times10^2$ Pa in the figure) during Al-deoxidation. When the pressure in the vacuum vessel is higher than $2\times10^3$ Pa ($1\times10^4$ Pa), the nitrogen concentration increases greatly and 0.0100 to 0.0120 mass % or more can be attained relatively easily. It shows similar trend also in a case where the nitrogen concentration is set to 0.0100 mass % or more after the decarburization refining. In view of keeping a stirring force in the vessel, it is desirable that the upper limit for the pressure in the vacuum vessel is $2.0\times10^4$ Pa or less, preferably, $1.5\times10^4$ Pa or less.

Further, it is also effective to increase the N concentration by adding a nitrogen-containing alloy such as N—Mn with low C content as [mass % C]/[mass % N]$\leqq$0.1 together with blowing or instead of blowing of the nitrogen-containing gas such that the C concentration in the molten steel does not exceeds 0.0050 mass %. While the nitrogen-containing alloy used in this case is not inexpensive, since the addition amount can be kept minimum, there is less burden in view of the cost. The advantageous feature of utilizing the nitrogen-containing alloy is a rapid increase in the nitrogen concentration and this is particularly effective in a case where the aimed value for the N concentration is as high as 0.0200 mass % or more.

For the steel produced in this invention, there is no particular restriction except for carbon, nitrogen and Al. However, it is preferred to control the ingredients within the following composition range as the material for steel sheets to be worked and it particularly preferred to add one or more of Nb, B and Ti.

Nb is effective for the grain refinement of the hot rolled texture and cold rolled recrystallization annealed texture by combined addition with B and also has an effect of fixing solid solute C as NbC. This effect is not sufficient if the amount of Nb is less than 0.0050 mass %, whereas the ductility is lowered when it exceeds 0.0500 mass %. Accordingly, Nb is desirably incorporated in a range from 0.0050 to 0.500 mass %, preferably, 0.0100 to 0.0300 mass %.

B is useful for the grain refinement of hot rolled texture and cold rolled recrystallization annealing texture by combined addition with Nb, and also has an effect of improving the resistance to secondary working enbrittlement. When the amount of B is less than 0.0005 mass %, the efficient is insufficient and if it exceeds 0.0050 mass %, it is less solid solved in the heating stage of the cast slab. Accordingly, B is desirably incorporated within a range from 0.0005 to 0.0050 mass %, preferably, from 0.0005 to 0.0015 mass %.

Ti may not particularly be added but may be added by 0.001 mass % or more with a view point of grain refining the texture. However, it is preferred to be 0.070 mass % or less for satisfying the relation (4). Further, less than 0.001 mass % of Ti sometimes present as inevitable impurities.

In addition, when O is incorporated in excess of 0.0070 mass % as the total oxygen amount, inclusions in the slabs or the steel sheets increase to bring about various surface defects. Then, it is preferred to apply a sufficient Al-deoxidation treatment to suppress the total oxygen amount to 0.0070 mass % or less.

Si is an element particularly preferred for addition in a case of suppressing lowering of elongation and improving the strength but, since the surface property is worsened and the ductility is lowered if it exceeds 1.0 mass %, it is preferably 1.0 mass % or less and, desirably, 0.5 mass % or less. While there is no particular requirement for defining the lower limit value, it is usually contained by 0.005 mass % or more.

Mn is useful as an element for strengthening the steel but since the surface property is worsened or the ductility is lowered if it exceeds 2.0 mass %, it is preferably 2.0 mass % or less. There is no particular requirement for defining the lower limit value. Since this is a useful element as described above, it is usually incorporated by 0.05 mass % or more with no particular reducing treatment.

In addition, each of Mo, Cu, Ni and Cr may be added by 2.0 mass % or less and each of V, Zr and P may be added by 0.1 mass % or less as a strengthening element. However, P is often present by about 0.03 mass % or less as inevitable impurities with no particular addition. Further, while addition of Cr is advantageous for increasing nitrogen content, it is preferably 0.3% or less in view of the workability of obtained steel sheets. As other inevitable impurity, S may be contained by 0.04 mass % or less.

The composition-controlled molten steel is formed into a rolling material (cast slab) by a continuous casting facility. The continuous casting condition may be in accordance with the customary method with no particular restriction. That is, the molten steel is cast into slabs of a size of 100 to 300 mm thickness and around 900 to 2000 mm width by using a well-known vertical bend type continuous casting machine, vertical type continuous casting machine or bend type continuous casting machine. The slabs just after casting may optionally be adjusted to a desired width by a method, for example, of lateral pressing or lateral forging.

The cast slabs are hot rolled by a customary method into hot rolled steel sheets. The hot rolled steel sheets may optionally be applied with hot-rolled sheet annealing. While the hot rolled steel sheets may be used as final products, they may be preferably applied with cold rolling and annealing at a temperature higher than the recrystallization temperature into cold rolled sheets. Further, a surface treatment may properly applied to them.

EXAMPLE

Inventive Example 1

A primary decarburizing treatment was applied to 250 t of molten iron in a converter furnace to lower the C concentration as far as 0.0300 mass %. In this state, the N concentration was 0.0040 mass % and the Mn concentration was 0.07 mass % in the molten steel. Subsequently, N—Mn alloy (C: 1.5 mass %, Mn: 73 mass %, N: 5 mass %) was added by 5 kg/t into a ladle upon tapping from a converter furnace to increase the N concentration in the molten steel in the ladle to 0.0140 mass %. In this state, the C concentration was increased to 0.0400 mass % and the Mn concentration was increased to 0.40 mass %.

For decarburization of the molten steel into the ultra low carbon steel, secondary carburization refining was applied by a vacuum decarburizing treatment in an RH type vacuum degassing facility. [mass % N]−0.15[mass % C] before the secondary decarburization refining was 0.0080 mass % to ensure 0.0060 mass % or more of concentration. During the vacuum decarburizing treatment, the pressure in a vacuum vessel was $1\times10^2$ Pa, the dissolved oxygen concentration before the treatment was 0.0520 mass %, and a nitrogen gas was used for the circulation gas from the snorkel, which was blown at a gas flow rate of 3000 Nl/min (that is 12 Nl/min·t per one ton of molten steel). The concentration of the dissolved oxygen during the vacuum decarburizing treatment was always kept at 0.0350 mass % or more by top blowing an oxygen gas from the lance in the vacuum vessel. After the vacuum decarburizing treatment for 20 min, the C concentration was lowered to 0.0020 mass % and the N concentration was lowered to 0.0100 mass %. $\Delta N/\Delta C$ during the vacuum decarburizing treatment was 0.105, which was smaller than 0.15. Further, the concentration of dissolved oxygen was 0.0380 mass %.

Subsequently, after increasing the pressure in the vacuum vessel to $1\times10^4$ Pa, Al was added by 0.8 kg/t to the molten steel for deoxidation. The Al concentration after deoxidation was 0.015 mass %. Successively, a nitrogen gas was blown as a circulation gas from a snorkel at 3000 Nl/min (that is 12 Nl/min·t per ton of molten steel). 5 min after the addition of Al, a low C N—Mn alloy (C: 0.2 mass %, Mn: 80 mass %, N: 8 mass %) was added by 3 kg/t. Subsequently, FeNb was added by 0.06 kg/t and FeB was added by 0.007 kg/t. Ti and Si were not added particularly and Mn was added as Met.Mn by 4.0 kg/t.

An RH deoxidizing treatment was completed 15 min after Al-deoxidation. The N concentration was increased to 0.0150 mass % upon completion. Further, the C concentration was 0.0030 mass % and the Al concentration was 0.010 mass %. [mass % Al]·[mass % N] was 0.00015, achieving a value smaller than 0.0004. Further, Nb was 0.0050 mass %, B was 0.0005 mass %, Ti was 0.001 mass %, Si was 0.01 mass % and Mn was 1.0 mass %. Since the value for 0.0030+14/27[mass % Al]+14/93[mass % Nb]+14/11[mass % B]+14/48[mass % Ti] determined from the composition was 0.0102 mass %, the N concentration after refining could be increased to more than the value. Other steel composition comprised 0.010 mass %, of P, 0.010 mass % of S and other inevitable impurities.

Table 1 shows main production conditions and the results.

TABLE 1

| Section | | | Inventive Example 1 | Inventive Example 2 | Comp. Example 1 |
|---|---|---|---|---|---|
| Molten iron amount | | | 250 ton | 250 ton | 250 ton |
| After primary decarburization re-fining | N addition gas | Type | no | No | no |
| | Composition after refining | C | 0.03% | 0.03% | 0.03% |
| | | Mn | 0.07% | 0.07% | 0.07% |
| | | N | 0.0040% | 0.0040% | 0.0040% |
| On tapping | N—Mn alloy addition amount | | 5 kg/ton | 5 kg/ton | 5 kg/ton |
| | High carbon Fe—Mn addition amount | | — | — | — |
| | Content for alloy | C | 1.5% | 1.5% | 1.5% |
| | | Mn | 73% | 73% | 73% |
| | | N | 5% | 5% | 5% |
| Ladle after tapping | Ladle Composition | C | 0.040% | 0.030% | 0.040% |
| | | Mn | 0.40% | 0.40% | 0.40% |
| | | N | 0.0140% | 00.165% | 0.0140% |
| Vacuum decarburizing treatment | Before treatment [% N] −0.15 [% C] | | 0.0080% | 0.0120% | 0.0080% |
| | Dissolved Oxygen before treatment | | 0.0520% | 0.0480% | 0.0280% |
| | Vacuum degree | | $1 \times 10^2$ Pa | $1 \times 10^2$ Pa | $1 \times 10^2$ Pa |
| | (Snorkel) gas | Type | $N_2$ | $N_2$ | $N_2$ |
| | | Flow rate | 12 Nl/min. ton | 12 Nl/min. ton | 12 Nl/min. ton |
| | Reducing gas | | no | no | no |
| | Dissolved oxygen during treatment | | ≧0.0350% | ≧0.0350% | <0.0300% |
| | Treating time | | 20 min. | 20 min. | 20 min. |
| | Composition after treating | C | 0.0020% | 0.0020% | 0.0020% |
| | | N | 0.0100% | 0.0130% | 0.0040% |
| | ΔN/ΔC (2) in treatment | | 0.105 | 0.125 | 0.263 |
| | Dissolved oxygen after treatment | | 0.0380% | 0.0380% | 0.0260% |
| Deoxidation treatment | Al addition amount | | 0.8 kg/ton | 0.8 kg/ton | 0.8 kg/ton |
| | Vacuum degree | | $1 \times 10^4$ Pa | $1 \times 10^4$ Pa | $1\times 10^4$ Pa |
| | (snorkel) gas | Type | $N_2$ | $N_2$ | $N_2$ |
| | | Flow rate | 12 Nl/min · ton | 12 Nl/min · ton | 12 Nl/min · ton |
| | N—Mn alloy addition amount | | 3 kg/ton | 2 kg/ton | 4 kg/ton |
| | Content for alloy | C | 0.2% | 0.2% | 0.2% |
| | | Mn | 8% | 8% | 8% |
| | | N | 80% | 80% | 80% |
| | Alloy [% C]/[% N] | | 0.025 | 0.025 | 0.025 |
| | Fe—Nb alloy addition amount | | 0.06 kg/ton | no | 0.06 kg/ton |
| | FeB alloy addition amount | | 0.007 kg/ton | no | 0.007 kg/ton |
| | Met. Mn alloy addition amount | | 4 gk/ton | no | 4 kg/ton |
| | Fe—Ti alloy addition amount | | no | no | no |
| | Treating time | | 15 min | 15 min | 15 min |
| | Composition after treatment (composition after refining) | C | 0.0030% | 0.0030% | 0.0030% |
| | | N | 0.0150% | 0.0160% | 0.0090% |
| | | Al | 0.010% | 0.010% | 0.010% |
| | | Si | 0.01% | 0.01% | 0.01% |
| | | Mn | 1.00% | 0.54% | 1.02% |
| | | Nb | 0.005% | 0.001% | 0.005% |
| | | B | 0.0005% | 0.0001% | 0.0005% |
| | | Ti | 0.001% | 0.001% | 0.002% |
| | | Total O | 0.0030% | 0.0035% | 0.0035% |
| | Required N concentration: right side in (4) | | 0.0102% | 0.0088% | 0.0102% |
| | % Al × % N: left side in (3) | | 0.00016% | 0.00016% | 0.00009% |

Note)
% generally means mass % but means vol % at normal temperature - normal pressure for the gas.
Flow rate shows $N_2$-converted value.

The molten steel was continuously cast into slabs by a vertical bend type continuous casting machine and, after heating the slabs in a slab heating furnace at 1150° C., they were hot rolled in a tandem hot rolling mill into hot rolled sheets of 3.5 mm thickness and made hot coils (finishing temperature: 920° C., cooling rate after rolling: 55° C./s, coiling temperature: 600° C.). The hot coils were cold rolled into 0.7 mm thickness (reduction: 80%) in a cold rolling mill, and then subjected to recrystallization annealing in a continuous annealing line (temperature elevation rate: 15° C./s, temperature: 840° C.) and, subsequently, put to temper rolling at a reduction of 1.0%.

A tensile test was conducted for the thus obtained steel sheets (temper rolled material). Further, a tensile test was also conducted for steel sheets prepared by applying 10% tensile strain and applying an aging heat treatment at 120° C. for 20 min for the steel sheets described above (age hardened material). A difference ΔTS=TS2−TS1 was determined between the tensile strength of the age hardened material (TS2) and the tensile strength of the temper rolled material (TS1) based on the test for both of them, which was determined as an age hardening amount. As a result, a large age hardening amount of ΔTS=100 MPa was obtained. Further, in the stage of slabs and sheet bars, there were no surface crack and the surface quality of the cold rolled steel sheet was also satisfactory.

Inventive Example 2

A primary decarburizing treatment was applied to 250 t of molten iron in a converter furnace to lower the C concentration as far as 0.0300 mass %. In this state, the N concentration was 0.0040 mass % and the Mn concentration was 0.07 mass % in the molten steel. Subsequently, N—Mn alloy (C: 1.5 mass %, Mn: 73 mass %, N: 5 mass %) was added by 5 kg/t into a ladle upon tapping from a converter furnace to increase the N concentration in the molten steel in the ladle to 0.0165 mass %. In this state, the C concentration was increased to 0.0300 mass % and the Mn concentration was increased to 0.40 mass %.

For decarburization of the molten steel into the ultra low carbon steel, secondary carburization refining was applied by a vacuum decarburizing treatment in an RH type vacuum degassing facility. [mass % N]–0.15[mass % C] before the secondary decarburization refining was 0.0120 mass % to ensure 0.100 mass % or more of concentration. During the vacuum decarburizing treatment, the pressure in a vacuum vessel was $1\times10^2$ Pa, the dissolved oxygen concentration before the treatment was 0.0480 mass %, and a nitrogen gas was used for the circulation gas from the snorkel, which was blown at a gas flow rate of 3000 Nl/min. The concentration of the dissolved oxygen during the vacuum decarburizing treatment was always kept at 0.0350 mass % or more by top blowing an oxygen gas from the lance in the vacuum vessel. After the vacuum decarburizing treatment for 20 min, the C concentration was lowered to 0.0020 mass % and the N concentration was lowered to 0.0130 mass %. ΔN/ΔC during the vacuum decarburizing treatment was 0.125, which was smaller than 0.15. Further, the concentration of dissolved oxygen was 0.0380 mass %.

Subsequently, after increasing the pressure in the vacuum vessel to $1\times10^4$ Pa, Al was added by 0.8 kg/t to the molten steel for deoxidation. The Al concentration after deoxidation was 0.012 mass %. Successively, a nitrogen gas was blown as a circulation gas from a snorkel at 3000 Nl/min. 5 min after the addition of Al, a low C N—Mn alloy (C: 0.2 mass %, Mn: 80 mass %, N: 8 mass %) was added by 2 kg/t. An RH deoxidizing treatment was completed 15 min after Al-deoxidation. The N concentration was increased to 0.0160 mass % upon completion. Further, the C concentration was 0.0030 mass % and the Al concentration was 0.010 mass %. [mass % Al]·[mass % N] was 0.00016, achieving a value smaller than 0.0004.

Table 1 shows main production conditions and the results.

Other steel composition after refining comprises 0.010 mass % of P, 0.010% of S and other inevitable impurities. While Nb, B, Ti were not added in this steels, they were contained each by a slight amount as inevitable impurities.

When the resultant molten steels were subjected to continuous casting into slabs and sheet bars, favorable cast steels with no surface cracks were obtained. Further, the surface quality of cold rolled coils obtained by the same treatment as in Inventive Example 1 was favorable (surface defect ratio: 0.15 per 1000 m or less), and desired age hardening property could also be obtained.

Inventive Example 3

A primary refining-RH aluminum killed treatment (secondary refining-deoxidation-composition control) were applied under the conditions shown in Tables 2 and 3. The amount of the nitrogen-containing gas charged during the primary refining was as nitrogen gas: 1 $Nm^3$/t. Further, in the steels (after refining), the range for the main composition other than those described in the tables comprised P: 0.005 to 0.025 mass % and S: 0.005 to 0.025 mass %, with the balance of inevitable impurities.

TABLE 2

| Section | | | Inventive Ex. 3-1 | Inventive Ex. 3-2 | Inventive Ex. 3-3 | Inventive Ex. 3-4 | Inventive Ex. 3-5 |
|---|---|---|---|---|---|---|---|
| Molten iron amount | | | 250 ton | 250 ton | 250 ton | 250 ton | 250 ton |
| After primary decarburization refining | N addition gas | Type | $N_2$ | $N_2$ | no | no | $N_2$ |
| | Composition after refining | C | 0.03% | 0.03% | 0.03% | 0.03% | 0.03% |
| | | Mn | 0.10% | 0.10% | 0.10% | 0.10% | 0.10% |
| | | N | 0.0100% | 0.0140% | 0.0040% | 0.0040% | 0.0100% |
| On tapping | N—Mn alloy addition amount | | 5 kg/ton | — | 6 kg/ton | 4 kg/ton | 4 kg/ton |
| | High carbon Fe—Mn addition amount | | — | 5 kg/ton | — | — | — |
| | Content for alloy | C | 1.5% | 1.5% | 1.5% | 1.5% | 1.5% |
| | | Mn | 73% | 73% | 73% | 73% | 73% |
| | | N | 5% | 0 | 5% | 5% | 5% |
| Ladle after tapping | Ladle Composition | C | 0.038% | 0.038% | 0.039% | 0.036% | 0.036% |
| | | Mn | 0.45% | 0.45% | 0.52% | 0.38% | 0.38% |
| | | N | 0.0200% | 0.0140% | 0.0160% | 0.0120% | 0.0180% |
| Vacuum decarburizing treatment | Before treatment [% N] −0.15 [% C] | | 0.0144% | 0.0084% | 0.0102% | 0.0066% | 0.0126% |
| | Dissolved Oxygen before treatment | | 0.0420% | 0.0400% | 0.0380% | 0.0430% | 0.0380% |
| | Vacuum degree | | $1\times10^2$ Pa | $1\times10^2$ Pa | $1\times10^2$ Pa | $1\times10^2$ Pa | $1\times10^2$ Pa |
| | (snorkel) gas | Type | $N_2$ | $N_2$ | $N_2$ | $N_2$ + 30% $H_2$ | $N_2$ |
| | | Flow rate | 12 Nl/min. ton | 12 Nl/min ton | 8 Nl/min ton | 12 Nl/min ton | 10 Nl/min ton |
| | Reducing gas | | no | no | no | $H_2$ (30 vol %) | no |
| | Dissolved oxygen during treatment | | ≧0.0350% | ≧0.0350% | ≧0.0350% | ≧0.0350% | ≧0.0350% |
| | Treating time | | 15 min. | 15 min. | 15 min. | 15 min. | 15 min. |
| | Composition | C | 0.0020% | 0.0020% | 0.0020% | 0.0020% | 0.0020% |

TABLE 2-continued

| Section | | | Inventive Ex. 3-1 | Inventive Ex. 3-2 | Inventive Ex. 3-3 | Inventive Ex. 3-4 | Inventive Ex. 3-5 |
|---|---|---|---|---|---|---|---|
| | after treating | N | 0.0150% | 0.0114% | 0.0116% | 0.0120% | 0.0133% |
| | ΔN/ΔC (2) in treatment | | 0.141 | 0.073 | 0.119 | 0.000 | 0.138 |
| | Dissolved oxygen after treatment | | 0.0400% | 0.0500% | 0.0430% | 0.0430% | 0.0430% |
| Deoxidation treatment | Al addition amount | | 0.7 kg/ton | 0.8 kg/ton | 0.8 kg/ton | 0.8 kg/ton | 0.8 kg/ton |
| | Vacuum degree | | $5 \times 10^3$ Pa | $1 \times 10^4$ Pa | $5 \times 10^3$ Pa | $5 \times 10^3$ Pa | $5 \times 10^3$ Pa |
| | (snorkel) gas | Type | $N_2$ | $N_2$ | $N_2$ | $N_2$ + 30% $H_2$ | $N_2$ |
| | | Flow rate | 12 Nl/min ton | 12 Nl/min ton | 8 Nl/min ton | 12 Nl/min. ton | 6 Nl/min. ton |
| | N—Mn alloy addition amount | | 2 kg/ton | no | 4 kg/ton | no | 4 kg/ton |
| | Content for alloy | C | 0.2% | | 0.2% | | 0.2% |
| | | Mn | 8% | | 8% | | 8% |
| | | N | 80% | | 80% | | 80% |
| | Alloy [% C]/[% N] | | 0.025 | | 0.025 | | 0.025 |
| | Fe—Nb alloy addition amount | | 0.06 kg/ton | 0.06 kg/ton | 0.06 kg/ton | 0.06 kg/ton | 0.06 kg/ton |
| | FeB alloy addition amount | | 0.007 kg/ton | 0.007 kg/ton | 0.007 kg/ton | 0.007 kg/ton | 0.007 kg/ton |
| | Met. Mn alloy addition amount | | 2 kg/ton | 4 kg/ton | no | no | no |
| | Fe—Ti alloy addition amount | | no | no | no | no | no |
| | Treating time | | 15 min | 15 min | 15 min | 15 min | 15 min |
| | Composition after treatment (composition after refining) | C | 0.0024% | 0.0020% | 0.0028% | 0.0020% | 0.0028% |
| | | N | 0.0138% | 0.0105% | 0.0126% | 0.0100% | 0.0140% |
| | | Al | 0.008% | 0.008% | 0.008% | 0.008% | 0.008% |
| | | Si | 0.01% | 0.01% | 0.01% | 0.01% | 0.01% |
| | | Mn | 0.75% | 0.78% | 0.78% | 0.36% | 0.65% |
| | | Nb | 0.005% | 0.005% | 0.005% | 0.005% | 0.005% |
| | | B | 0.0005% | 0.0005% | 0.0005% | 0.0005% | 0.0005% |
| | | Ti | 0.001% | 0.001% | 0.001% | 0.001% | 0.001% |
| | | Total O | 0.0030% | 0.0030% | 0.0030% | 0.0030% | 0.0030% |
| | Required N concentration: right side in (4) | | 0.0088% | 0.0088% | 0.0088% | 0.0088% | 0.0088% |
| | % Al × % N: left side in (3) | | 0.00011% | 0.00008% | 0.00010% | 0.00008% | 0.00011% |

Note)
% generally means mass % but means vol % at normal temperature - normal pressure for the gas.
Flow rate shows $N_2$-converted value.

TABLE 3

| Section | | | Inventive Ex. 3-6 | Inventive Ex. 3-7 | Inventive Ex. 3-8 | Inventive Ex. 3-9 |
|---|---|---|---|---|---|---|
| Molten iron amount | | | 250 ton | 250 ton | 250 ton | 250 ton |
| After primary decarburization re-fining | N addition gas | Type | $N_2$ | $N_2$ | $N_2$ | no |
| | Composition after refining | C | 0.04% | 0.03% | 0.03% | 0.03% |
| | | Mn | 0.10% | 0.10% | 0.10% | 0.10% |
| | | N | 0.0140% | 0.0100% | 0.0140% | 0.0040% |
| On tapping | N—Mn alloy addition amount | | 4 kg/ton | 2 kg/ton | no | 6 kg/ton |
| | High carbon Fe—Mn addition amount | | no | no | 5 kg/ton | no |
| | Content for alloy | C | 1.5% | 1.5% | 1.5% | 1.5% |
| | | Mn | 73% | 73% | 73% | 73% |
| | | N | 5% | 5% | | 5% |
| Ladle after tapping | Ladle composition | C | 0.046% | 0.033% | 0.038% | 0.039% |
| | | Mn | 0.38% | 0.24% | 0.45% | 0.52% |
| | | N | 0.0220% | 0.0140% | 0.0140% | 0.0160% |
| Vacuum decarburizing treatment | Before treatment [% N] −0.15 [% C] | | 0.0151% | 0.0091% | 0.0084% | 0.0102% |
| | Dissolved Oxygen before treatment | | 0.0380% | 0.0380% | 0.0250% | 0.0380% |
| | Vacuum degree | | $1 \times 10^2$ Pa | $1 \times 10^2$ Pa | $1 \times 10^2$ Pa | $1 \times 10^2$ Pa |
| | (snorkel) gas | Type | $N_2$ | $N_2$ | $N_2$ | $N_2$ + 20% Ar |
| | | Flow rate | 12 Nl/min ton | 12 Nl/min ton | 12 Nl/min. ton | 8 Nl/min. ton |
| | Reducing gas | | no | no | no | no |
| | Dissolved oxygen during treatment | | ≧0.0350% | ≧0.0350% | <0.0300% | ≧0.0350% |
| | Treating time | | 15 min. | 15 min. | 15 min. | 15 min. |
| | Composition after treating | C | 0.0020% | 0.0020% | 0.0030% | 0.0020% |
| | | N | 0.0162% | 0.0114% | 0.0093% | 0.0116% |
| | ΔN/ΔC (2) in treatment | | 0.132 | 0.084 | 0.136 | 0.119 |
| | Dissolved oxygen after treatment | | 0.0430% | 0.0430% | 0.0280% | 0.0430% |
| Deoxidation treat- | Al addition amount | | 0.8 kg/ton | 0.8 kg/ton | 0.8 kg/ton | 0.8 kg/ton |
| | Vacuum degree | | $1 \times 10^4$ Pa | $4 \times 10^3$ Pa | $1 \times 10^4$ Pa | $1 \times 10^2$ Pa |
| | (snorkel) gas | Type | $N_2$ | $N_2$ + 20% Ar | $N_2$ | Ar |

TABLE 3-continued

| Section | | | Inventive Ex. 3-6 | Inventive Ex. 3-7 | Inventive Ex. 3-8 | Inventive Ex. 3-9 |
|---|---|---|---|---|---|---|
| ment | | Flow rate | 12 Nl/min. ton | 8 Nl/min. ton | 12 Nl/min ton | 12 Nl/min ton |
| | N—Mn alloy addition amount | | 4 kg/ton | no | 2 kg/ton | 8 kg/ton |
| | Content for alloy | C | 0.2% | | 0.2% | 0.2% |
| | | Mn | 8% | | 8% | 8% |
| | | N | 80% | | 80% | 80% |
| | Alloy [% C]/[% N] | | 0.025 | | 0.025 | 0.0.25 |
| | Fe—Nb alloy addition amount | | 0.06 kg/ton | 0.06 kg/ton | 0.06 kg/ton | 0.06 kg/ton |
| | FeB alloy addition amount | | 0.007 kg/ton | 0.007 kg/ton | 0.007 kg/ton | 0.007 kg/ton |
| | Met. Mn alloy addition amount | | 4 kg/ton | no | 4 kg/ton | no |
| | Fe—Ti alloy addition amount | | no | no | no | no |
| | Treating time | | 15 min | 15 min | 15 min | 15 min |
| | Composition after treatment (Composition after refining) | C | 0.0028% | 0.0020% | 0.0034% | 0.0036% |
| | | N | 0.0180% | 0.0093% | 0.0102% | 0.0099% |
| | | Al | 0.015% | 0.008% | 0.008% | 0.008% |
| | | Si | 0.01% | 0.01% | 0.01% | 0.01% |
| | | Mn | 1.01% | 0.23% | 0.93% | 1.07% |
| | | Nb | 0.010% | 0.005% | 0.005% | 0.005% |
| | | B | 0.0010% | 0.0005% | 0.0005% | 0.0005% |
| | | Ti | 0.012% | 0.001% | 0.001% | 0.001% |
| | | Total O | 0.0030% | 0.0030% | 0.0030% | 0.0030% |
| | Required N concentration: right side in (4) | | 0.0171% | 0.0088% | 0.0088% | 0.0088% |
| | % Al × % N: left side in (3) | | 0.00027% | 0.00007% | 0.00008% | 0.00008% |

Note)
% generally means mass % but means vol % at normal temperature - normal pressure for the gas.
Flow rate shows $N_2$-converted value.

Any of the steels according to the production method satisfying the requirements of this invention could provide favorable cast steels with no surface crackings upon producing slabs and sheet bars. Further, the cold rolled steel sheet coils obtained by applying the same treatment as in Inventive Example 1 to the inventive steels described above also had satisfactory surface quality (surface defect ratio: 0.15 N/1000 m or less). Further, the age hardening property was also obtained for the cold rolled steel sheets as ΔTS: 60 to 110 MPa (80 MPa or more in Inventive Examples 3-1, 2, 3 and 5) by the same measuring method as in Inventive Example 1.

Comparative Example 1

A primary decarburization refining was applied to 250t of molten iron in a converter furnace to lower the C concentration to 0.0300 mass %. In this state, the N concentration was 0.0040 mass % and the Mn concentration was 0.07 mass % in the molten steel. Subsequently, an N—Mn alloy (C: 1.5 mass %, Mn: 73 mass %, N: 5 mass %) was added by 5 kg/t into a ladle upon tapping from a converter to increase the N concentration of the molten steel in the ladle to 0.0140 mass %. In this state, the C concentration was increased to 0.0400 mass % and the Mn concentration was increased to 0.40 mass %.

For decarburizing the molten steel into a ultra low carbon steel, a secondary decarburization refining was conducted in an RH type vacuum degassing facility. [mass % N]−0.15 [mass % C] before the secondary decarburization refining was 0.0080 mass %, to ensure 0.0060 mass % or more. The pressure in a vacuum vessel during secondary decarburizing treatment was $1\times10^2$ Pa and the dissolved oxygen concentration before treatment was 0.0280 mass % and a nitrogen gas was used as a circulation gas from the submerged tube and blown at a gas flow rate of 3000 Nl/min (12 Nl/min·t). The concentration of the dissolved oxygen during the secondary decarburization refining was below 0.0300 mass % in the course of the process. After the secondary decarburization refining for 20 min, the C concentration was lowered to 0.0020 mass % and, further, the N concentration was lowered to 0.0040 mass %. ΔN/ΔC in the vacuum decarburizing treatment was 0.263 which was a value greater than 0.15. Further, the concentration of dissolved oxygen was 0.0263 mass %.

Subsequently, after increasing the pressure in the vacuum vessel to $1\times10^4$ Pa, Al was added by 0.8 kg/t to the molten steel to conduct deoxidation. The Al concentration after deoxidation was 0.015 mass %. As the circulation gas from the snorkel, the nitrogen gas was successively blown at 3000 Nl/min (12 Nl/min·t). 5 min after the addition of Al, a low C N—Mn alloy (C: 0.2 mass %, Mn: 80 mass %, N: 8 mass %) was added by 2 kg/t. Subsequently, FeNb was added by 0.06 kg/t and FeB was added by 0.007 kg/t. Ti and Si were not added particularly, and Mn was added as Met.Mn by 4.0 kg/t.

The RH killed treatment was completed 15 min after Al-deoxidation. The N concentration was increased to 0.0090 mass % upon completion. Further, C concentration was 0.0030 mass % and the Al concentration was 0.0100 mass %. [mass % Al]·[mass % N] was 0.00009. Further, Nb was 0.0050 mass %, B was 0.0005 mass %, Ti was 0.002 mass %, Si was 0.01 mass % and Mn was 1.0 mass %. Since the value for 0.0030+14/27[mass % Al]+14/93[mass % Nb]+14/11[mass % B]+14/48[mass % Ti] determined from the composition was 0.0102 mass %, the N concentration after refining could not be larger than the value. Further, also the N concentration of 0.0120 mass % could not be obtained naturally.

Table 1 shows main production conditions and the result. Other steel composition after refining comprised 0.010 mass % of P and 0.010% of S and other inevitable impurities.

The molten steel was continuously cast into slabs by a vertical bend type continuous casting machine and, after heating the slabs in a slab heating furnace at 1150° C., they were hot rolled in a tandem hot rolling mill into hot rolled sheets of 3.5 mm thickness and made hot coils (finishing temperature: 920° C., cooling rate after rolling: 55° C./s, coiling temperature: 600° C.). The hot coils were cold rolled into 0.7 mm thickness (reduction: 80%) in a cold rolling mill, and then subjected to recrystallization annealing in a continuous annealing line (temperature elevation rate: 15° C./s, temperature: 840° C.) and, subsequently, put to temper rolling at a reduction of 1.0%.

A tensile test was conducted for the thus obtained steel sheets (temper rolled material). Further, a tensile test was also conducted for steel sheets prepared by applying 10% tensile strain and applying an aging heat treatment at 120° C. for 20 min to the steel sheets described above (age hardened material). A difference ΔTS=TS2−TS1 was determined between the tensile strength of the age hardened material (TS2) and the tensile strength of the temper rolled material (TS1) based on the test for both of them, which was determined as an age hardening amount. As a result, ΔTS=5 MPa, and only the extremely small amount of age hardening could be obtained.

Comparative Example 2

Under the conditions shown in Table 4, a primary refining-RH aluminum killed treatment (secondary refining-deoxidation-composition control) were applied. Other steel composition than those described in Table 2 were identical with those in Inventive Example 3.

TABLE 4

| Section | | | Comp. Ex. 2-1 | Comp. Ex. 2-2 | Comp. Ex. 2-3 | Comp. Ex. 2-4 | Comp. Ex. 2-5 |
|---|---|---|---|---|---|---|---|
| Molten iron amount | | | 250 ton | 250 ton | 250 ton | 250 ton | 250 ton |
| After primary decarburization re-fining | N addition gas | Type | no | no | $N_2$ | no | $N_2$ |
| | Composition after refining | C | 0.03% | 0.03% | 0.02% | 0.02% | 0.04% |
| | | Mn | 0.10% | 0.10% | 0.10% | 0.10% | 0.10% |
| | | N | 0.0040% | 0.0040% | 0.0090% | 0.0040% | 0.0140% |
| On tapping | N—Mn alloy addition amount | | 5 kg/ton | 2 kg/ton | 2 kg/ton | 3 kg/ton | 5 kg/ton |
| | High carbon Fe-Mn addition amount | | — | — | — | — | — |
| | Content for alloy | C | 1.5% | 1.5% | 1.5% | 1.5% | 1.5% |
| | | Mn | 73% | 73% | 73% | 73% | 73% |
| | | N | 5% | 5% | 5% | 5% | 5% |
| Ladle after tapping | Ladle Composition | C | 0.038% | 0.033% | 0.023% | 0.025% | 0.048% |
| | | Mn | 0.45% | 0.24% | 0.24% | 0.31% | 0.45% |
| | | N | 0.0140% | 0.0080% | 0.0130% | 0.0100% | 0.0240% |
| Vacuum decarburizing treatment | Before treatment [% N] −0.15 [% C] | | 0.0084% | 0.0031% | 0.0096% | 0.0063% | 0.0169% |
| | Dissolved Oxygen before treatment | | 0.0380% | 0.0380% | 0.0380% | 0.0380% | 0.0380% |
| | Vacuum degree | | $1 \times 10^2$ Pa | $1 \times 10^2$ Pa | $1 \times 10^2$ Pa | $1 \times 10^2$ Pa | $1 \times 10^2$ Pa |
| | (snorkel) gas | Type | Ar | $N_2$ | $N_2$ | $N_2$ | $N_2$ |
| | | Flow rate | 12 Nl/min. ton | 12 Nl/min. ton | 12 Nl/min. ton | 12 Nl/min. ton | 12 Nl/min ton |
| | Reducing gas | | no | no | no | no | no |
| | Dissolved oxygen during treatment | | ≧0.0350% | ≧0.0350% | ≧0.0350% | ≧0.0350% | ≧0.0350% |
| | Treating time | | 15 min | 15 min | 15 min | 15 min | 15 min |
| | Composition after treating | C | 0.0020% | 0.0020% | 0.0020% | 0.0020% | 0.0020% |
| | | N | 0.0042% | 0.0078% | 0.0108% | 0.0090% | 0.0174% |
| | ΔN/ΔC (2) in treatment | | 0.276 | 0.006 | 0.105 | 0.044 | 0.145 |
| | Dissolved oxygen after treatment | | 0.0430% | 0.0430% | 0.0430% | 0.0430% | 0.0430% |
| Deoxidation treatment | Al addition amount | | 0.8 kg/ton | 0.8 kg/ton | 0.8 kg/ton | 0.5 kg/ton | 1.3 kg/ton |
| | Vacuum degree | | $5 \times 10^3$ Pa | $5 \times 10^3$ Pa | $5 \times 10^3$ Pa | $5 \times 10^3$ Pa | $1 \times 10^4$ Pa |
| | (snorkel) gas | Type | $N_2$ | $N_2$ | $N_2$ | $N_2$ | $N_2$ |
| | | Flow rate | 12 Nl/min. ton | 10 Nl/min. ton | 8 Nl/min. ton | 8 Nl/min. ton | 12 Nl/min. ton |
| | N—Mn alloy addition amount | | 6 kg/ton | 4 kg/ton | 4 kg/ton | no | 4 kg/ton |
| | Content for alloy | C | 0.2% | 0.2% | 1.0% | no | 0.2% |
| | | Mn | 8% | 8% | 8% | no | 8% |
| | | N | 80% | 80% | 80% | no | 80% |
| | Alloy [% C]/[% N] | | 0.025 | 0.025 | 0.125 | no | 0.025 |
| | Fe—Nb alloy addition amount | | 0.06 kg/ton | 0.06 kg/ton | 0.06 kg/ton | 0.06 kg/ton | 0.06 kg/ton |
| | FeB alloy addition amount | | 0.007 kg/ton | 0.007 kg/ton | 0.007 kg/ton | 0.007 kg/ton | 0.007 kg/ton |
| | Met. Mn alloy addition amount | | 2 kg/ton | 2 kg/ton | 2 kg/ton | 5 kg/ton | 4 kg/ton |
| | Fe—Ti alloy addition amount | | no | no | no | no | no |
| | Treating time | | 20 min | 20 min | 15 min | 15 min | 15 min |
| | Composition after treatment (Composition after refining) | C | 0.0032% | 0.0028% | 0.0060% | 0.0020% | 0.0028% |
| | | N | 0.0084% | 0.0096% | 0.0120% | 0.0074% | 0.0191% |
| | | Al | 0.010% | 0.010% | 0.008% | 0.003% | 0.025% |
| | | Si | 0.01% | 0.01% | 0.01% | 0.01% | 0.01% |
| | | Mn | 1.04% | 0.69% | 0.69% | 0.74% | 1.07% |
| | | Nb | 0.005% | 0.005% | 0.005% | 0.010% | 0.005% |
| | | B | 0.0005% | 0.0005% | 0.0005% | 0.0010% | 0.0005% |
| | | Ti | 0.002% | 0.002% | 0.001% | 0.001% | 0.001% |
| | | Total O | 0.0035% | 0.0035% | 0.0030% | 0.0090% | 0.0030% |

TABLE 4-continued

| Section | | Comp. Ex. 2-1 | Comp. Ex. 2-2 | Comp. Ex. 2-3 | Comp. Ex. 2-4 | Comp. Ex. 2-5 |
|---|---|---|---|---|---|---|
| | Required N concentration: right side in (4) | 0.0102% | 0.0102% | 0.0088% | 0.0076% | 0.0176% |
| | % Al × % N: left side in (3) | 0.00008% | 0.00010% | 0.00010% | 0.00002% | 0.00048% |

Note)
% generally means mass % but means vol % at normal temperature-normal pressure for the gas.
Flow rate shows $N_2$-converted value.

Any of Comparative Example 2-5 insufficient for Al deoxidation and high total oxygen amount and Comparative Example 2-4 with % Al×% N (=[mass % Al]·[mass % N]) exceeding 0.0004 suffered from surface defects in slabs or cold rolled steel sheets.

In Comparative Examples 2-1 and 2-2, since the production conditions were not within the preferred range, even when the time of the deoxidation treatment was prolonged, the N concentration after refining could not be larger than the value for 0.0030+14/17[mass % Al]+14/93[mass % Nb]+14/11[mass % B]+14/48[mass % Ti] and the N concentration of 0.0120 mass % could not be obtained as well. Further, also in Comparative Example 2-4, since the oxygen concentration was high during deoxidation period, the above relation for solid solute N could not be satisfied, and the N concentration of 0.0120 mass % could not be obtained as well. Further, in Comparative Example 2-5, consumption of N in the steel by Al is large and the above relation for the solid solute N could not be satisfied. The age hardening property of the cold rolled sheets obtained from the steels described above was much lower than ΔTS: 60 MPa.

In Comparative Example 2-3, while the N concentration was high, since an N—Mn alloy not with low carbon content was used for the addition upon deoxidation treatment, desired ultra low carbon concentration could not be obtained and the workability was insufficient for press forming for use in automobile parts.

INDUSTRIAL APPLICABILITY

As has been described above, the rolling material formed by continuous casting of steels obtained by the method according to this invention can produce ultra low carbon and high nitrogen cold-rolled sheets with less surface defects, wherein the steel sheets obtained by rolling said material (cold-rolled steel sheets) have excellent age hardening property, and can provide a material optimal, for example, to structural parts for use in automobiles. Further, compared with the case of attempting the production of ultra low carbon steels by the production method for high nitrogen steels proposed so far, it is reliable, requires less cost and can obtain high productivity.

FIG. 1

(1) Surface defect ratio of cold rolled coil (number of defects per 1000 m coil)
(2) [mass % Al]·[mass % N] in steel

FIG. 3

(1) Blow hole defect in cast slab
(2) Surface cracking in cast slab
(3) High oxygen, defect by huge oxide
(4) Preferred range
(5) Insufficient solid solute N,
Insufficient Aging property,

FIG. 4

(1) Concentration range before and during decarburizing treatment
(2) Range after decarburizing treatment

FIG. 5

(1) Concentration range before and during decarburizing treatment
(2) Range after decarburizing treatment

FIG. 6

(1) Nitrogen concentration 20 min after $N_2$ gas blowing [mass %]
(2) Nitrogen concentration after decarburizing treatment [mass %]
(3) Pressure in vessel
(4) Equilibrated [mass % N] at $1\times10^4$ Pa
(5) Equilibrated [mass % N] at $5\times10^2$ Pa

What is claimed is:

1. A method of producing a high nitrogen, ultra low carbon steel of preparing a rolling material for use in ultra low carbon steel sheets at: C≦0.0060 mass %, characterized by applying primary decarburization refining to molten iron from a blast furnace and controlling composition in the molten steel after the primary decarburization refining into a range satisfying the following relation (1), then, conducting secondary decarburization refining to a ultra low carbon concentration region at: C≦0.0050 mass % so as to satisfy the following relation (2) in a vacuum degassing facility, subsequently applying deoxidation by Al so as to provide: Al≧0.005 mass % after deoxidation and controlling the composition such that the Al concentration and the N concentration satisfy the following relation (3), and the N concentration satisfies N: 0.0050 to 0.0250 mass %, and the following relation (4) or N≧0.0120 mass %, and successively casting the composition-controlled molten steel continuously:

Note:

$$[\text{mass \% N}]-0.15[\text{mass \% C}]\geqq 0.0060 \quad (1)$$

$$\Delta N/\Delta C\leqq 0.15 \quad (2)$$

in which

ΔN: reduction amount of the N concentration in steel in secondary decarburization refining (mass %)

ΔC: reduction amount of the C concentration in steel in secondary decarburization refining (mass %)

$$[\text{mass \% Al}]\cdot[\text{mass \% N}]\leqq 0.0004 \quad (3)$$

$$[\text{mass \% N}]\geqq 0.0030+14/27[\text{mass \% Al}]+14/93[\text{mass \% Nb}]+14/11[\text{mass \% B}]+14/48[\text{mass \% Ti}] \quad (4),$$

providing that

[mass % Nb]=0 in steel not containing Nb

[mass % B]=0 in steel not containing B

[mass % Ti]=0 in steel not containing Ti.

2. A method of producing a high nitrogen ultra low carbon steel as defined in claim 1, wherein the composition control is conducted so that the N concentration satisfies the following relation (4):

Note:

$$[\text{mass \% N}]\geqq 0.0030+14/27[\text{mass \% Al}]+14/93[\text{mass \% Nb}]+14/11[\text{mass \% B}]+14/48[\text{mass \% Ti}] \quad (4),$$

providing that

[mass % Nb]=0 in steel not containing Nb

[mass % B]=0 in steel not containing B

[mass % Ti]=0 in steel not containing Ti.

3. A method of producing a high nitrogen, ultra low carbon steel as defined in claim 1, wherein the composition are controlled such that the N concentration is 0.0120 mass % or more in the ingredient control.

4. A method of producing a high nitrogen, ultra low carbon steel as defined in claim 1, wherein the composition in the molten steel after the primary decarburization refining is controlled as: N≧0.0080 mass %.

5. A method of producing a high nitrogen, ultra low carbon steel as defined in claim 1, wherein the composition in the molten steel after the primary decarburization refining are controlled within a range satisfying the following relation (5):

note:

$$[\text{mass \% N}]-0.15[\text{mass \% C}]\geqq 0.0100 \quad (5).$$

6. A method of producing a high nitrogen, ultra low carbon steel as defined in claim 1, wherein a gas that contains a nitrogen gas is blown into the molten steel during the secondary decarburization refining.

7. A method of producing a high nitrogen, ultra low carbon steel as defined in claim 6, wherein the gas that contains the nitrogen is blown at a nitrogen gas flow rate: 2 Nl/min·t or more into the molten steel, to provide: $\Delta N/\Delta C\leqq 0.15$.

8. A method of producing a high nitrogen, ultra low carbon steel as defined in claim 6, wherein gas that contains the nitrogen gas further contains a reducing gas.

9. A method of producing a high nitrogen, ultra low carbon steel an defined in claim 8, wherein the reducing gas is 5 to 50% by volume (normal temperature·normal pressure) of gas that contains the nitrogen gas.

10. A method of producing a high nitrogen, ultra low carbon steel as defined in claim 1, wherein the oxygen concentration in the molten steel is controlled to 0.0300 mass % or more in the secondary decarburization refining to provide: $\Delta N/\Delta C\leqq 0.15$.

11. A method of producing a high nitrogen, ultra low carbon steel as defined in claim 1, wherein the composition in the molten steel after the primary decarburization refining are controlled by adding an N-containing alloy to the molten steel after the primary decarburization refining and before the secondary decarburization refining.

12. A method of producing a high nitrogen, ultra low carbon steel as defined in claim 1, wherein a gas that contains a nitrogen gas is blown upon primary carburization refining to control the composition in the molten steel after the primary decarburization refining.

13. A method of producing a high nitrogen, ultra low carbon steel as defined in claim 1, wherein the N concentration is controlled by blowing a gas that contains a nitrogen gas at a nitrogen gas flow rate: 2 Nl/min·t or more into the molten steel during deoxidation by Al in a vacuum degassing facility after the secondary decarburization refining.

14. A method of producing a high nitrogen, ultra low carbon steel as defined in claim 13, wherein gas that contains the nitrogen gas further contains a reducing gas.

15. A method of producing a high nitrogen, ultra low carbon steal as defined in claim 1, wherein lowering of the N concentration is suppressed by controlling the pressure in a vacuum vessel upon deoxidation by Al in the vacuum degassing facility after the secondary carburization refining to $2\times10^3$ Pa or more.

16. A method of producing a high nitrogen, ultra low carbon steel as defined in claim 1, wherein the N concentration is controlled by adding an N-containing alloy of [mass % C]/[mass % N]≦0.1 into the molten steel upon deoxidation by Al in the vacuum degassing facility after the secondary decarburization refining.

17. A method of producing a high nitrogen, ultra low carbon steel as defined in claim 1, wherein the composition of the composition-controlled molten steel after the refining treatment contains Si: 1.0 mass % or less, Mn: 2.0 mass % or less, and the total oxygen concentration: 0.0070 mass % or less, and one or more of Nb: 0.0050 to 0.0500 mass %, B: 0.0005 to 0.0050 mass % and Ti: 0.070 mass % or less, and the substantial balance of Fe.

18. A method of producing high nitrogen, ultra low carbon steel as defined in claim 1, wherein the high nitrogen, ultra low carbon steel is a rolling material for use in ultra low carbon steel sheets of high age hardening property.

19. A method of producing a high nitrogen, ultra low carbon steel of preparing a rolling material, for use in ultra low carbon steel sheets at: C≦0.0050 mass %, characterized by applying primary decarburization refining to molten iron from a blast furnace then controlling the composition in the molten steel to a range satisfying the following relation (5) by adding an N-containing alloy, then, conducting secondary decarburization refining to a ultra low carbon concentration region at: C≦0.0050 mass % so as to satisfy the following relation (2) in a vacuum degassing facility, by setting the oxygen concentration in the molten steel to 0.0300 mass % or more, and while blowing a gas that contains a nitrogen gas at a nitrogen gas flow rate: 2 Nl/min·t or more into the molten steel, subsequently setting the pressure in a vacuum vessel to $2\times10^3$ Pa or more while conducting deoxidation by Al such that Al≧0.005 mass % after deoxidation and blowing a gas that contains a nitrogen gas at a nitrogen gas flow rate: 2 Nl/min·t or more into a molten steel, optionally adding an N-containing alloy of [mass % C]/[mass % N]≦0.1 into the molten steel, thereby controlling the composition such that the Al concentration and the N concentration satisfy the following relation (3), and the N concentration satisfies N: 0.0050 to 0.0250 mass %, and the following relation (4) or N≧0.0120 mass % and, successively casting the composition-controlled molten steel continuously:

Note:

$$[\text{mass \% N}]-0.15[\text{mass \% C}]\geqq 0.0100 \quad (5)$$

$$\Delta N/\Delta C\leqq 0.15 \quad (2)$$

in which $\Delta N$: reduction amount of the N concentration in steel in secondary decarburization refining (mass %), $\Delta C$: reduction amount of the C concentration in steel in secondary decarburization refining (mass %)

$$[\text{mass \% Al}]\cdot[\text{mass \% N}]\leqq 0.0004 \quad (3)$$

$$[\text{mass \% N}]\geqq 0.0030+14/27[\text{mass \% Al}]+14/93[\text{mass \% Nb}]+14/11[\text{mass \% B}]+14/48[\text{mass \% Ti}] \quad (4),$$

providing that

[mass % Nb]=0 in steel not containing Nb

[mass % B]=0 in steel not containing B

[mass % Ti]=0 in steel not containing Ti.

* * * * *

UNITED STATES PATENT AND TRADEMARK OFFICE

CERTIFICATE OF CORRECTION

PATENT NO. : 6,764,528 B2
DATED : July 20, 2004
INVENTOR(S) : Nabeshima et al.

It is certified that error appears in the above-identified patent and that said Letters Patent is hereby corrected as shown below:

Column 24,
Line 39, please change "C≤0.0060" to -- C≤0.0050 --.

Signed and Sealed this

Nineteenth Day of April, 2005

JON W. DUDAS
*Director of the United States Patent and Trademark Office*